US010731483B2

(12) United States Patent
Kottilingam et al.

(10) Patent No.: US 10,731,483 B2
(45) Date of Patent: Aug. 4, 2020

(54) THERMAL MANAGEMENT ARTICLE

(71) Applicant: GENERAL ELECTRIC COMPANY, Schenectady, NY (US)

(72) Inventors: Srikanth Chandrudu Kottilingam, Simpsonville, SC (US); Jon Conrad Schaeffer, Simpsonville, SC (US); Brian Lee Tollison, Honea Path, SC (US); Yan Cui, Greer, SC (US); David Edward Schick, Greenville, SC (US)

(73) Assignee: General Electric Company, Schenectady, NY (US)

( * ) Notice: Subject to any disclaimer, the term of this patent is extended or adjusted under 35 U.S.C. 154(b) by 628 days.

(21) Appl. No.: 14/962,759

(22) Filed: Dec. 8, 2015

(65) Prior Publication Data

US 2017/0159488 A1 Jun. 8, 2017

(51) Int. Cl.

| | |
|---|---|
| ***F01D 5/28*** | (2006.01) |
| ***F01D 25/12*** | (2006.01) |
| ***F28F 13/18*** | (2006.01) |

(52) U.S. Cl.

CPC ..... *F01D 5/288* (2013.01); *F01D 25/12* (2013.01); *F28F 13/18* (2013.01); *F05D 2230/232* (2013.01); *F05D 2230/313* (2013.01); *F05D 2230/90* (2013.01); *F05D 2240/11* (2013.01); *F05D 2300/611* (2013.01)

(58) Field of Classification Search

CPC ..... F01D 25/12; F01D 5/288; F28F 13/18

See application file for complete search history.

(56) References Cited

U.S. PATENT DOCUMENTS 4,259,037 A * 3/1981 Anderson ..... F01D 5/185 416/92

6,113,722 A 9/2000 Hoffman et al.

(Continued)

FOREIGN PATENT DOCUMENTS

EP 1462613 A1 9/2004
EP 2728034 A1 5/2014

(Continued)

OTHER PUBLICATIONS

Luthra, Mechanism of Adhesion of Alumina on MCrAlY Alloys, 1986, Springer, Oxidation of Metals, vol. 26, Nos. 5/6, 1986, pp. 397-416 (Year: 1986).*

(Continued)

*Primary Examiner* — Kayla Mccaffrey
*Assistant Examiner* — John S Hunter, Jr.
(74) *Attorney, Agent, or Firm* — Hoffman Warnick LLC

(57) ABSTRACT

A thermal management article is disclosed including a substrate and a first coating disposed on the substrate. The first coating includes a first coating surface and at least one passageway disposed between the substrate and the first coating surface. The at least one passageway defines at least one fluid pathway. A method for forming a thermal management article is disclosed including attaching at least one passageway to a substrate. The at least one passageway includes a passageway wall having a wall thickness and defines at least one fluid pathway. A first coating is applied to the substrate and the passageway wall, forming a first coating surface. The at least one passageway is disposed between the substrate and the first coating surface.

14 Claims, 3 Drawing Sheets

(56) References Cited

U.S. PATENT DOCUMENTS

| | | | | |
|---|---|---|---|---|
| 6,617,003 | B1 | 9/2003 | Lee et al. | |
| 7,412,320 | B2 * | 8/2008 | Brummel | F01D 5/189 415/115 |
| 7,658,590 | B1 | 2/2010 | Spanks | |
| 10,247,010 | B2 * | 4/2019 | Arrell | B23P 15/04 |
| 2010/0239409 | A1 * | 9/2010 | Draper | F01D 5/005 415/1 |

FOREIGN PATENT DOCUMENTS

| | | | |
|---|---|---|---|
| EP | 2863014 | A1 | 4/2015 |
| WO | 2055863 | A1 | 7/2002 |
| WO | 2013120999 | A1 | 8/2013 |

OTHER PUBLICATIONS

European Search Report and Opinion issued in connection with corresponding European Application No. 16202587.8 dated Mar. 21, 2017.

* cited by examiner

THERMAL MANAGEMENT ARTICLE

FIELD OF THE INVENTION

The present invention is directed to thermal management articles and methods for forming thermal management articles. More particularly, the present invention is directed to thermal management articles and methods for forming thermal management articles including at least one passageway disposed between a substrate and a first coating surface. The thermal management articles may include, but are not limited to, gas turbine components.

BACKGROUND OF THE INVENTION

Gas turbines are continuously being modified to increase efficiency and decrease cost. One method for increasing the efficiency of a gas turbine includes increasing the operating temperature. Increases in operating temperature result in more extreme operating conditions which have led to the development of advanced superalloy materials and complex coating systems designed to increase the heat tolerance of the turbine components and protect the turbine components from reactive gasses in the hot gas path of the gas turbine.

The temperature tolerance of a turbine component may also be increased through the use of cooling channels. Cooling channels are typically incorporated into the metal and ceramic substrates of turbine components used in high temperature regions of gas turbines. However, the distance between the cooling channels and the surface of the turbine component exposed to the hot gas path of the gas turbine affects the cooling effect of the cooling channels. Increasing thicknesses of protective coatings on turbine components separating the cooling channels from the hot gas path decreases the effectiveness of cooling channels.

BRIEF DESCRIPTION OF THE INVENTION

In an exemplary embodiment, a thermal management article includes a substrate and a first coating disposed on the substrate. The first coating includes a first coating surface and at least one passageway disposed between the substrate and the first coating surface. The at least one passageway defines at least one fluid pathway.

In another exemplary embodiment, a method for forming a thermal management article includes attaching at least one passageway to a substrate. The at least one passageway includes a passageway wall having a wall thickness and defines at least one fluid pathway. A first coating is applied to the substrate and the passageway wall, forming a first coating surface. The at least one passageway is disposed between the substrate and the first coating surface.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary thermal management articles and methods for forming thermal management articles. Embodiments of the present disclosure, in comparison to methods not utilizing one or more features disclosed herein, reduce manufacturing costs, increase cooling efficiency, increase heat transfer efficiency, increase operating temperature tolerance, increase operating efficiency, decrease cooling fluid usage, increase power output, or a combination thereof.

Figure 1:
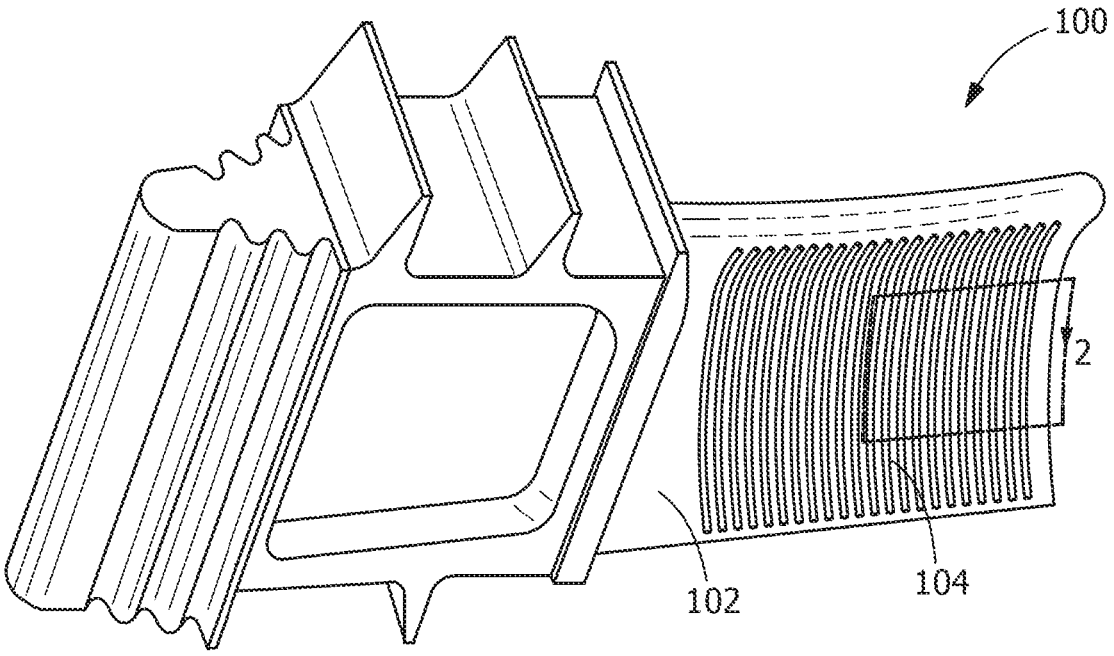
FIG. 1 is a perspective view of a thermal management article, according to an embodiment of the present disclosure.

Referring to FIG. 1, a thermal management article 100 includes a substrate 102 and at least one passageway 104. In one embodiment, the substrate 102 is a turbine component. In one embodiment, as shown, the at least one passageway 104 is disposed on the substrate 102, prior to a coating being applied to the at least one passageway 104. The turbine component may be any suitable turbine component, including, but not limited to, a hot gas path component, a blade (bucket) (shown), a vane (nozzle), a shroud, a combustor, a combustor liner, a combustion transition piece, or a combination thereof. The substrate 102 may include one or more coatings.

The substrate 102 may include any suitable substrate material, including, but not limited to, a metal, an alloy, an iron-based alloy, a ceramic, a steel, a MCrAlY, a thermal barrier coating, a bond coating, an environmental barrier coating, a fiber glass composite, a carbon composite, a refractory alloy, a chromium-molybdenum alloy, a chromium-molybdenum-vanadium alloy, a cobalt-chromium-molybdenum alloy, a superalloy, a nickel-based superalloy, a cobalt-based superalloy, a ceramic matrix composite, a carbon-fiber-reinforced carbon (C/C), a carbon-fiber-reinforced silicon carbide (C/SiC), a silicon-carbide-fiber-reinforced silicon carbide (SiC/SiC), or a combination thereof.

Figure 2:
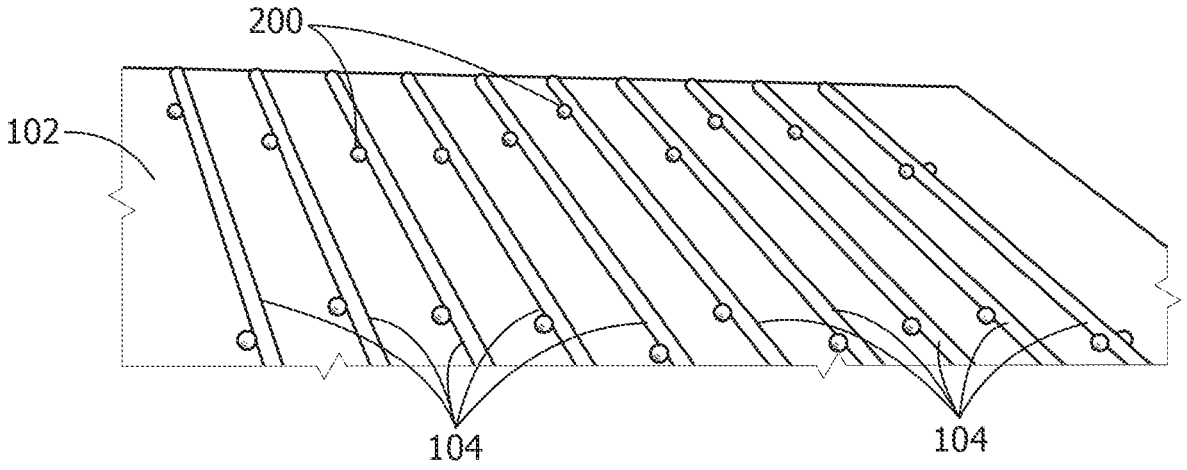
FIG. 2 is an expanded perspective view of a portion of the thermal management article of FIG. 1, according to an embodiment of the present disclosure.

Referring to FIG. 2, in one embodiment, a method for forming the thermal management article 100 includes attaching the at least one passageway 104 to the substrate 102. Attaching the at least one passageway 104 to the substrate 102 may include any suitable attachment technique, including, but not limited to, welding (shown) the at least one passageway 104 to the substrate by forming connecting welds 200, resistance welding the at least one passageway 104 to the substrate 102, brazing the at least one passageway 104 to the substrate 102, brazing the at least one passageway 104 to the substrate 102 with a braze paste, brazing the at least one passageway 104 to the substrate 102 with a braze tape, brazing the at least one passageway 104 to the substrate 102 with a braze foil, brazing the at least one passageway 104 to the substrate 102 with a braze sheet, brazing the at least one passageway 104 to the substrate 102 with a pre-sintered preform, adhering the at least one passageway 104 to the substrate 102 with a high temperature adhesive, or a combination thereof.

In one embodiment, the at least one passageway 104 is connected to and in fluid communication with a fluid source (not shown). The fluid source may be any suitable source, including, but not limited to, a channel, a cavity, a hole, a vent, a vessel, a fluid supply line, a manifold, a plenum, or a combination thereof. The fluid source may be disposed on the substrate 102, within the substrate 102, within the thermal management article 100, or a combination thereof. In one embodiment, a cooling fluid passes from the fluid source into and through the at least one passageway 104.

The at least one passageway 104 may include any suitable average outer diameter. In one embodiment, the average outer diameter is from about 0.01 inches to about 0.1 inches, alternatively from about 0.02 inches to about 0.075 inches, alternatively from about 0.03 inches to about 0.045 inches, alternatively less than about 0.25 inches, alternatively less than about 0.1 inches, alternatively less than about 0.05 inches.

Figure 3A:
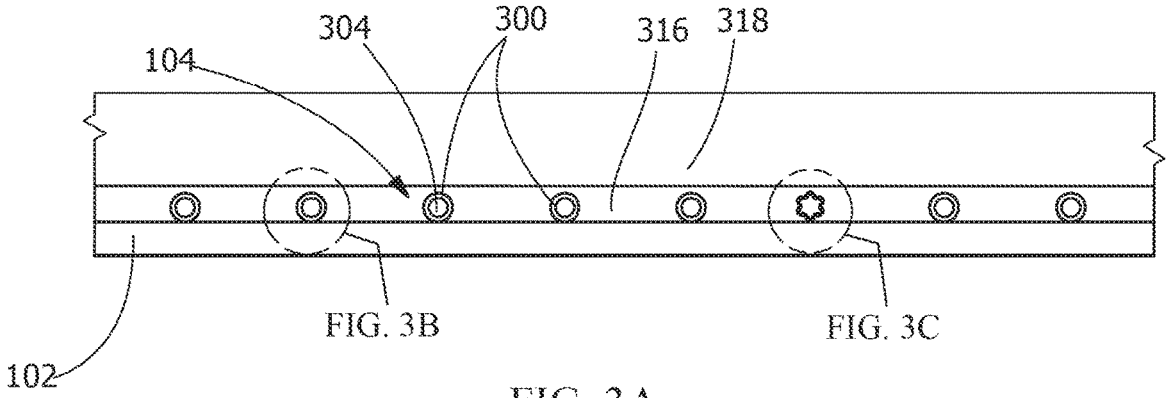
FIG. 3A is a perspective sectional view of the portion of the thermal management article of FIG. 2 having a first coating, according to an embodiment of the present disclosure.
Figure 3B:
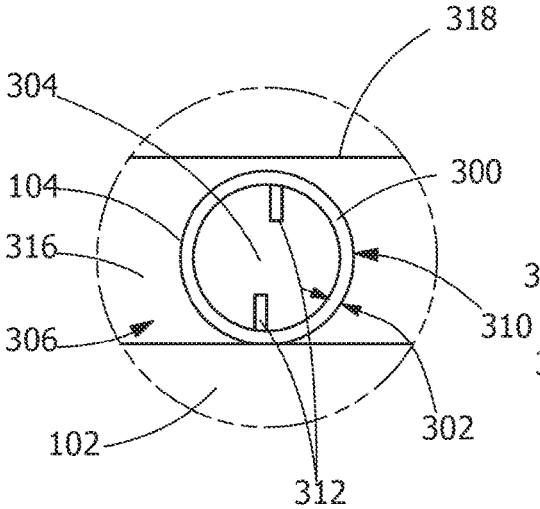
FIG. 3B and FIG. 3C are perspective sectional views of portions of the thermal management article of FIG. 3A, according to embodiment of the present invention.
Figure 3C:
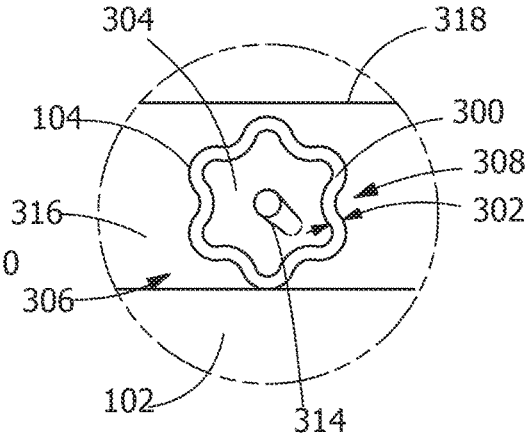

Referring to FIG. 3A-FIG. 3C, in one embodiment, the at least one passageway 104 includes a passageway wall 300 having a wall thickness 302 and defining at least one fluid pathway 304. The at least one fluid pathway 304 may be in fluid communication with the fluid source. The passageway wall 300 may be attached to the substrate 102 or unattached to the substrate 102. As used herein, "attached to the substrate 102" indicates that the passageway wall 300 is in direct physical contact with substrate 102 in at least one location. The at least one passageway 104 includes a length and a geometry. The geometry of the at least one passageway 104 may remain constant along the length of the at least one passageway 104 or may change along the length of the at least one passageway 104. In one embodiment, the geometry of the at least one passageway 104 conforms to the geometry of the substrate 102. The geometry of the at least one passageway 104 may be pre-conformed to the geometry of the substrate, or may be conformed to the geometry of the substrate during application of the at least one passageway 104. As used herein, the geometry of the at least one passageway 104 being "conformed" to the geometry of the substrate 102 indicates that the geometry of the at least one passageway 104 is sufficiently similar to the portion of the geometry of the substrate 102 to which the at least one passageway 104 is applied that the at least one passageway 104 would contact the substrate 102 along substantially the entire length of the at least one passageway 104 if the at least one passageway 104 were placed directly in contact with the portion of the geometry of the substrate 102.

The passageway wall 300 may include any suitable wall material, including, but not limited to, a superalloy, a nickel-based superalloy, a cobalt-based superalloy, a stainless steel, an alloy steel, a titanium alloy, an aluminum alloy, a refractory alloy, a ceramic, a yttrium-stabilized zirconia, an alumina, or a combination thereof. As used herein, a "refractory alloy" may include, but is not limited to, alloys of niobium, molybdenum, tungsten, tantalum, rhenium, vanadium, and combinations thereof.

In one embodiment, the wall thickness 302 is less than about 0.06 inches, alternatively less than about 0.03 inches, alternatively less than about 0.02 inches, alternatively less than about 0.015 inches, alternatively between about 0.001 inches to about 0.06 inches, alternatively between about 0.001 inches to about 0.03 inches, alternatively between about 0.002 inches and about 0.0025 inches, alternatively between about 0.003 inches to about 0.02 inches, alternatively between about 0.005 inches and about 0.015 inches.

The at least one passageway 104 includes a cross-sectional conformation 306. The cross-sectional conformation 306 may be constant along the length of the at least one passageway 104 or may change along the length of the at least one passageway 104. The cross-sectional conformation 306 may be any suitable conformation, including, but not limited to, a regular shape, an irregular shape, a fluted shape (308), a circle (310), an ellipse, an oval, a polygon, a triangle, a quadrilateral, a square, a rectangle, a trapezoid, a parallelogram, a pentagon, a hexagon, a heptagon, an octagon, or a combination thereof. In one embodiment, the at least one passageway 104 includes at least one turbulator 312 impinging on the at least one fluid pathway 304. The at least one turbulator may include any suitable structure, including, but not limited to a pin (shown), a pin bank, a pedestal, a fin, a bump, or a combination thereof.

In one embodiment, the at least one passageway 104 includes at least one sensor 314 disposed within the at least one fluid pathway 304. The at least one sensor 314 may be any suitable device, including, but not limited to, a thermocouple, a thermometer, a manometer, a pressure transducer, a mass flow sensor, a gas meter, an oxygen sensor, a water sensor, a moisture sensor, an accelerometer, a piezo vibration sensor, or a combination thereof.

The thermal management article 100 includes a first coating 316 disposed on the substrate 102. The first coating 316 includes a first coating surface 318. The at least one passageway 104 is disposed between the substrate 102 and the first coating surface 318. The first coating 316 may be any suitable coating, including, but not limited to, at least one of a thermal barrier coating, an environmental barrier coating, a thermally grown oxide, a ceramic top coat, a bond coating, a diffusion coating, an abradable coating, and a porous coating. Bond coatings may include, but are not limited to, MCrAlY coatings. Thermal barrier coatings may include, but are not limited to, ceramic coatings.

In one embodiment, a method for forming the thermal management article 100 includes applying the first coating 316 to the substrate 102 and the passageway wall 300, forming the first coating surface 318. Applying the first coating 316 may include any suitable technique, including, but not limited to, at least one of thermal spray, air plasma spray, high velocity oxygen fuel thermal spray, high velocity air fuel spray, vacuum plasma spray, and electron beam physical vapor deposition.

In another embodiment, the method for forming the thermal management article 100 includes applying a portion of the first coating 316 to the substrate 102 prior to the at least one passageway 104 being positioned in association with the substrate 102 or attached to the substrate 102, followed by positioning the at least one passageway 104 on the portion of the first coating 316 and applying the remainder of the first coating 316 to the substrate 102 and the passageway wall 300.

In an alternate embodiment (not shown), the at least one passageway 104 may be formed between the substrate 102 and the first coating surface 318 by applying the first coating 316 with an additive manufacturing technique such as, but not limited to, three-dimensional printing.

Figure 4:
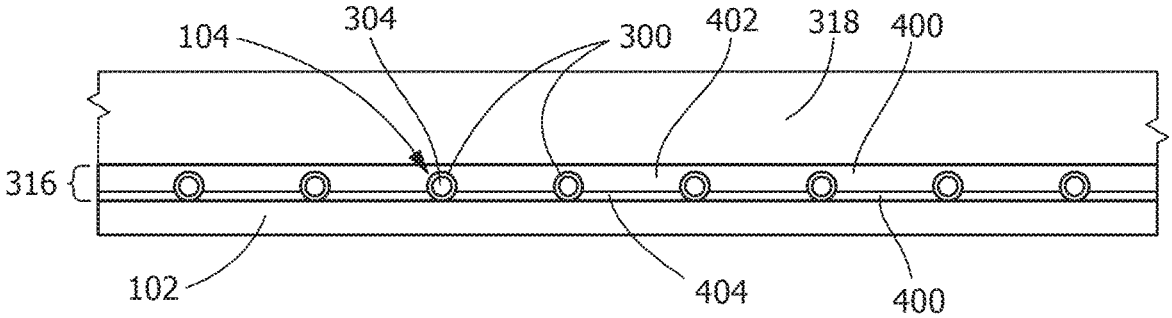
FIG. 4 is a perspective sectional view of the portion of the thermal management article of FIG. 2 having a first coating including a plurality of coating layers, according to an embodiment of the present disclosure.

Referring to FIG. 4, in one embodiment, the first coating 316 includes a plurality of coating layers 400. Each of the plurality of coating layers 400 in the first coating 316 may be the same coating or a different coating as each other of the plurality of coating layers 400 in the first coating 316. The plurality of coating layers 400 may be applied sequentially or simultaneously. In one embodiment, the plurality of coating layers 400 includes a first coating layer 402 and a second coating layer 404. The plurality of coating layers 400 is not limited to the first coating layer 402 and the second coating layer 404, but rather may include a third coating layer, and any number of additional coating layers. In one embodiment, the first coating layer 402 includes a bond coating and the second coating layer 404 includes a thermal barrier coating.

In one embodiment, the first coating layer 402 includes a thickness of from about 0.001 inches to about 0.05 inches, alternatively from about 0.002 inches to about 0.025 inches, alternatively from about 0.003 inches to about 0.015 inches, alternatively from about 0.005 inches to about 0.01 inches, alternatively less than about 0.05 inches, alternatively less than about 0.025 inches, alternatively less than about 0.015 inches. In another embodiment, the second coating layer 404 includes a thickness of from about 0.005 inches to about 0.25 inches, alternatively from about 0.01 inches to about 0.15 inches, alternatively from about 0.02 inches to about 0.06 inches, alternatively less than about 0.25 inches, alternatively less than about 0.15 inches, alternatively less than about 0.1 inches.

Figure 5A:
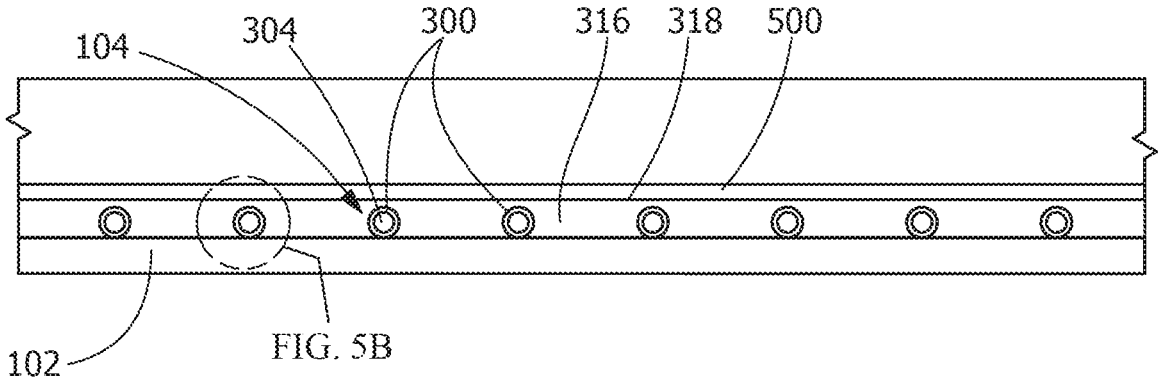
FIG. 5A is a perspective sectional view of the portion of the thermal management article of FIG. 3A having a second coating, according to an embodiment of the present disclosure.
Figure 5B:
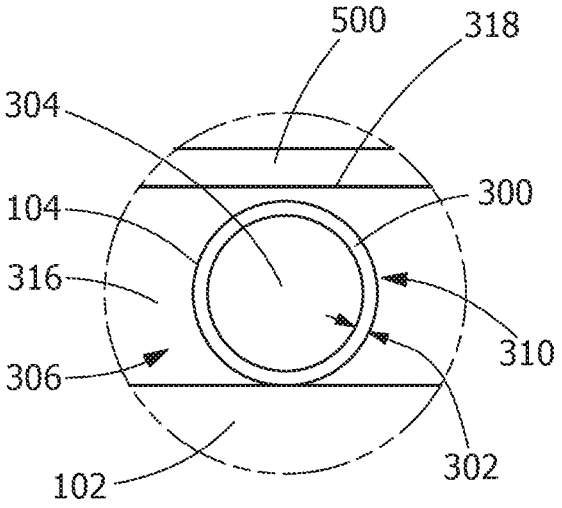
FIG. 5B is a perspective sectional view of the portion of the thermal management article of FIG. 5A, according to an embodiment of the present invention.

Referring to FIG. 5A and FIG. 5B, in one embodiment, the thermal management article 100 includes a second coating 500 disposed on the first coating surface 318. The second coating 500 may be any suitable coating, including, but not limited to, at least one of a thermal barrier coating, an environmental barrier coating, a thermally grown oxide, a ceramic top coat, a bond coating, a diffusion coating, an abradable coating, and a porous coating. The thermal management article 100 is not limited to the first coating 316 and the second coating 500, but rather may include a third coating, and any number of additional coatings applied to the second coating 500. In one embodiment, the first coating 316 is a bond coating and the second coating 500 is a thermal barrier coating. In another embodiment, the first coating 316 is a bond coating, the second coating 500 is a thermal barrier coating, and the third coating is an abradable coating.

A method for forming the thermal management article 100 may include applying the second coating 500 to the first coating surface 318. Applying the second coating 500 may include any suitable technique, including, but not limited to, at least one of thermal spray, air plasma spray, high velocity oxygen fuel thermal spray, high velocity air fuel spray, vacuum plasma spray, and electron beam physical vapor deposition. Applying the second coating 500 may include any suitable technique, including, but not limited to, at least one of thermal spray, air plasma spray, high velocity oxygen fuel thermal spray, high velocity air fuel spray, vacuum plasma spray, and electron beam physical vapor deposition.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A thermal management article, comprising:

a substrate having an outer surface;

a first coating disposed on the outer surface of the substrate, the first coating including a first coating surface;

at least one passageway disposed between the outer surface of the substrate and the first coating surface, the at least one passageway having a passageway wall defining at least one fluid pathway; and a second coating disposed between the outer surface of the substrate and the first coating, wherein the passageway wall includes a lowermost surface in direct contact with the outer surface of the substrate and an uppermost surface adjacent to the first coating surface, wherein the first coating is selected from the group consisting of at least one of a thermal barrier coating, a thermally grown oxide, a ceramic top coat, a bond coating, a diffusion coating, and a porous coating and wherein the thermal barrier coating is a ceramic coating, and wherein the second coating includes: a second coating surface aligned with the lowermost surface of the passageway wall, and a third coating surface opposite to the second coating surface and disposed between the uppermost surface and the lowermost surface of the passageway wall.

2. The thermal management article of claim 1, wherein the thermal management article is a turbine component.

3. The thermal management article of claim 2, wherein the turbine component is a hot gas path component.

4. The thermal management article of claim 1, wherein the passageway wall includes a wall material selected from the group consisting of a superalloy, a nickel-based superalloy, a cobalt-based superalloy, a stainless steel, an alloy steel, a titanium alloy, an aluminum alloy, a refractory alloy, a ceramic, a yttrium-stabilized Zirconia, an alumnia, and combinations thereof.

5. The thermal management article of claim 1, wherein the passageway wall has a thickness between 0.003 inches to 0.02 inches.

6. The thermal management article of claim 1, wherein the second coating is selected from the group consisting of a thermal barrier coating, a thermally grown oxide, a ceramic top coat, a bond coating, a diffusion coating, an abradable coating, and a porous coating.

7. The thermal management article of claim 1, wherein the at least one passageway includes a length and a geometry, the geometry changing along the length.

8. The thermal management article of claim 1, wherein the at least one passageway includes a cross-sectional conformation, the cross-sectional conformation being selected from a group consisting of a regular shape, an irregular shape, a fluted shape, a circle, an ellipse, an oval, a polygon, a triangle, a quadrilateral, a square, a rectangle, a trapezoid, a parallelogram, a pentagon, a hexagon, a heptagon, an octagon, and a combination thereof.

9. The thermal management article of claim 1, wherein the at least one passageway includes at least one turbulator impinging on the at least one fluid pathway.

10. The thermal management article of claim 1, wherein the at least one passageway includes at least one sensor disposed within the at least one fluid pathway.

11. The thermal management article of claim 1, wherein the passageway wall is attached to the outer surface of the substrate by at least one of welding, brazing or an adhesive.

12. The thermal management article of claim 1, wherein the first coating is MCrAlY.

13. The thermal management article of claim 1, wherein the first coating is the diffusion coating.

14. A thermal management article, comprising:

a substrate having an outer surface;

a first coating disposed on the outer surface of-the substrate, the first coating including a first coating surface;

at least one passageway disposed between the outer surface of the substrate and the first coating surface, the at least one passageway having a passageway wall defining at least one fluid pathway, wherein the passageway wall includes a lowermost surface in direct contact with the outer surface of the substrate and an uppermost surface adjacent to the first coating surface, and a second coating disposed between the outer surface of the substrate and the first coating, wherein the first coating is selected from the group consisting of at least one of a ceramic coating, a thermally grown oxide, and a ceramic top coat, and wherein the second coating includes: a second coating surface aligned with the lowermost surface of the passageway wall, and a third coating surface opposite to the second coating surface and disposed between the uppermost surface and the lowermost surface of the passageway wall.

* * * * *